United States Patent [19]

Wride et al.

[11] Patent Number: 4,970,743

[45] Date of Patent: Nov. 20, 1990

[54] MATTRESS AND FOUNDATION SYSTEM USEABLE WITH WATER MATTRESSES

[76] Inventors: Larry N. Wride, 353 Wilcrest Dr., Lawrenceville, Ga. 30244; Richard Hemsley, 951 Beaver La., Lilburn, Ga. 30247

[21] Appl. No.: 471,397

[22] Filed: Jan. 29, 1990

[51] Int. Cl.[5] ..... A47C 27/08

[52] U.S. Cl. ..... 5/451; 5/201; 5/400

[58] Field of Search ..... 5/451, 452, 449, 400, 5/455, 201

[56] References Cited

U.S. PATENT DOCUMENTS

| | | | |
|---|---|---|---|
| 3,735,432 | 5/1973 | Kreten et al. | 5/451 |
| 3,736,605 | 6/1973 | Klein, Jr. | 5/451 |
| 3,761,974 | 10/1973 | Kuss | 5/451 |
| 3,973,282 | 8/1976 | May . | |
| 4,073,019 | 2/1978 | Fraser | 5/451 |
| 4,125,912 | 11/1978 | Courter | 5/201 |
| 4,224,705 | 9/1980 | Santo | 5/400 |
| 4,306,322 | 12/1981 | Young et al. | 5/458 |
| 4,435,864 | 3/1984 | Callaway | 5/400 |
| 4,637,082 | 1/1987 | Moore et al. | 5/451 |
| 4,691,395 | 9/1987 | Corsetti | 5/400 |
| 4,734,946 | 4/1988 | Saputo | 5/400 |
| 4,737,998 | 4/1988 | Johnson, Sr. | 5/451 |
| 4,901,383 | 2/1990 | Yang et al. | 5/201 |

*Primary Examiner*—Alexander Grosz
*Attorney, Agent, or Firm*—James A. Hinkle

[57] ABSTRACT

A mattress and foundation bedding system having a knock-down capability for ease of assembly and disassembly, and for shipment and storage. The foundation has a core of honeycomb cells enclosed in an outer box and dressed with ticking material to resemble conventional bedding. The mattress has interlocking foam sidewal rails suitably reinforced to maintain its shape. The sidewall rails define a central cavity into which a sleep support system may be placed. The sleep support system may be fluid filled, or foam, or a conventional spring set, or other suitable supporting medium and is enclosed in a liner.

The entire mattress is enclosed in a removable ticking enclosure.

18 Claims, 5 Drawing Sheets

Fig_1
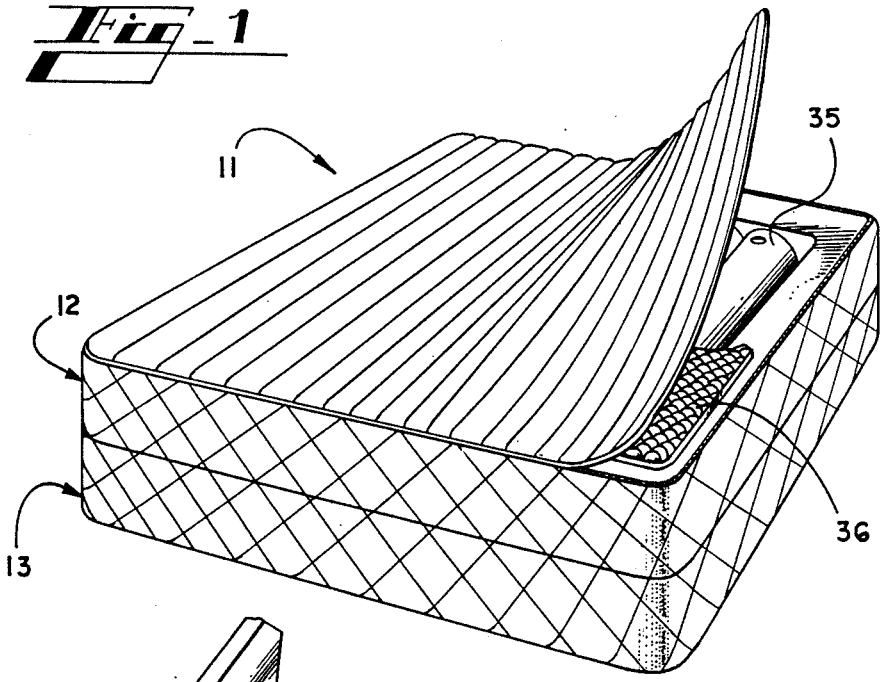
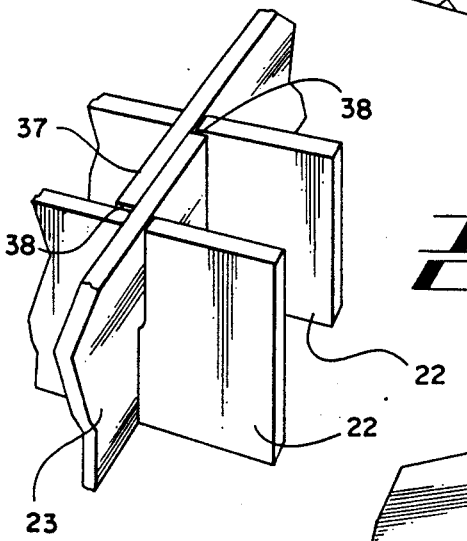
Fig_9
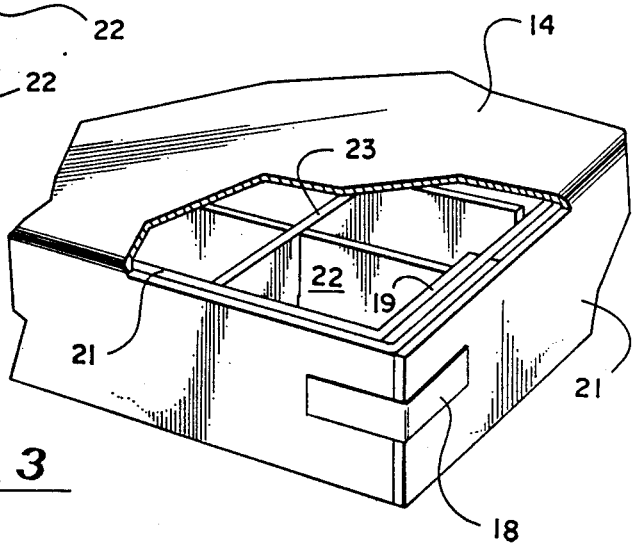
Fig_3

14
15
16
17
18
19
21
22
23
24a
24b
24c
24d
A
B
C

Fig_6
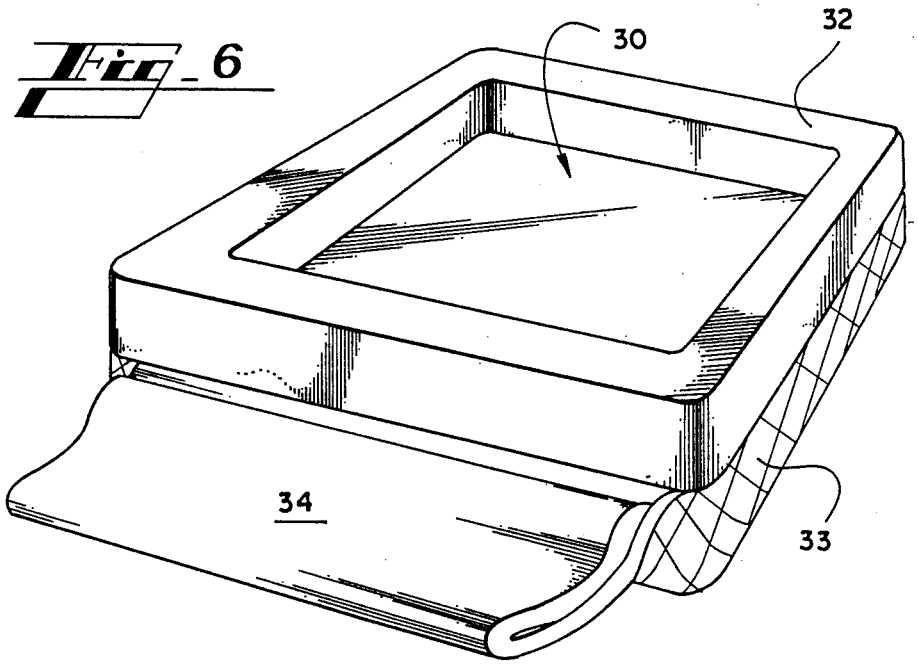
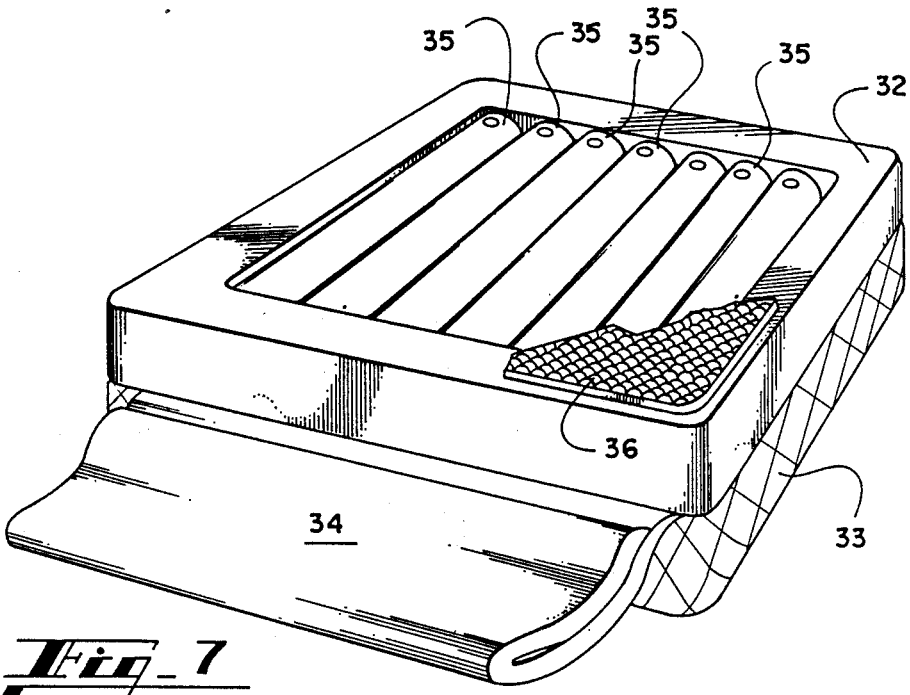
Fig_7

MATTRESS AND FOUNDATION SYSTEM USEABLE WITH WATER MATTRESSES

BACKGROUND OF THE INVENTION

I. Field of the Invention

The present invention relates generally to the field of mattress and foundation systems, and more particularly to a knock-down foundation and mattress for a conventional, fluid and/or foam support surface that, when assembled, would be of standard bedding measurements, but when disassembled can be shipped, handled and stored in less space more economically than any other current available system.

The present invention was described in a Disclosure Document indentified as No. 200,736.

II. Description of the Prior Art

Bedding foundations and mattresses are, of course, well known in the prior art. In addition to the conventional types of mattresses and foundations, there have been known in the recent past that fluid support mattresses, commonly known as waterbeds, possess certain benefits and appeal to a large segment of the population.

However, mattresses and foundations of all types are unusually bulky items and require substantial space for storage and, further, exhibit excessive bulk during the shipping process. Such bulk is very cost intensive from the shipping and warehousing standpoint.

There has been disclosed, in the prior art, means for reducing the bulk and complex nature of such sleep systems by utilizing knock-down features. There has never been a total integrated unitary system including a foundation and mattress combination which could be shipped and stored in a knock-down configuration so as to be transportable through the mail system anywhere in the world, and yet provide a standard size support structure and mattress system of conventional bedding sizes that is easily assembled and disassembled by the ultimate user without tools.

Thus, there exists a need for such a knock-down, integrated system of foundations and mattresses for conventional bedding, waterbeds, air beds and other types of bedding.

SUMMARY OF THE INVENTION

In accordance with the present invention, it is contemplated that a mattress and foundation bedding system will be provided that will eliminate the bulk, weight and cumbersome size of a mattress and foundation system. The present invention proposes a bedding system that will support large concentrated weight, but yet will be transportable enough to mail or to ship by common carrier without excess charges in a knocked-down condition, and yet will provide a standard conventional sized bedding system.

These and other objects are preferrably accomplished by providing a knock-down foundation having specially designed and engineered cell inserts to provide a honeycomb design which results in maximum strength to all areas of the foundation surface. The honeycomb design includes multiple cell structures of various geometric shapes. The honeycomb cell sections are collapsible to a near flat horizontal configuration for convenient storage, packaging, shipping and handling. Once the cell sections are unfolded into a usable configuration, top and bottom panels of a box-like configuration are placed about the cell sections to form a rectangular foundation to give an appearance of a standard bed foundation.

Therefore, when the foundation section is in a knocked-down configuration it will fit into a small carton for ease of shipping and handling. Of course, a cover may be provided to give the foundation a conventional look and appearance, especially as the foundation is placed on a standard bed frame.

The mattress section of the system consists of special foam perimeter sections which have a unique interlocking design to maintain the sections in operative relation with one another.

The foam sections are designed to stack or fold into a more compact size when disassembled for storing, packing and shipping in small economical containers. Once the perimeter foam blocks are assembled to form a perimeter support structure in the shape of a mattress, special fastening devices are used to maintain the interlocked sections together.

To provide support to an individual lying on the bed, the foam perimeter rails of the mattress have special material affixed to the foam rails, both in the length dimension and the width dimension, so that one may insert into the cavity formed by the foam rails a support system of either water, air, foam, conventional springs or other means, and to maintain the insert within the foam rails without the rails bowing outwardly from the internal pressure applied to the rails.

In addition, the mattress section of the system is provided with a special liner constructed to surround the foam rails and to act as an additional reinforcement to the foam side rails as well to provide a waterproofing mechanism to the foam. This eliminates any exposure of the foam rails to water or other substances that might be placed within the cavity formed thereby. If the foam rails are to be used in a waterbed environment, the liner also eliminates potential problems of leaks outside of the perimeter cavity and will also act as a buffer and protection for the foam side rails against any cavity inserts that might be placed within the cavity. The entire mattress section is then placed in a ticking cover to give a conventional appearance.

Other objects, advantages and capabilities of the invention will become apparent from the following description taken in conjunction with the accompanying drawings showing only a preferred embodiment of the invention.

BRIEF DESCRIPTION OF THE DRAWINGS

FIG. 1 is an overall perspective view of the finished mattress and foundation with the top pad of the mattress lifted to show a foam liner pad and filled fluid support tubes;

FIG. 3 is a perspective view of a portion of the completed foundation base cut away to show the reinforced corner configuration;

FIG. 6 is an overall perspective view showing the mattress and its foam sidewall rail units completely assembled with the vinyl liner placed over the foam side wall rails preparatory to being placed into the ticking bag;

FIG. 7 is a perspective view showing the finished mattress with the foam pad atop the mattress sidewall rail units and with the fluid tubes installed therein prior to being placed in the ticking bag cover;

FIG. 9 is a perspective view of a cut away portion of the honeycomb inserts of the foundation showing the overlap brace for structural rigidity of the same.

DESCRIPTION OF THE PREFERRED EMBODIMENT

Figure 2:
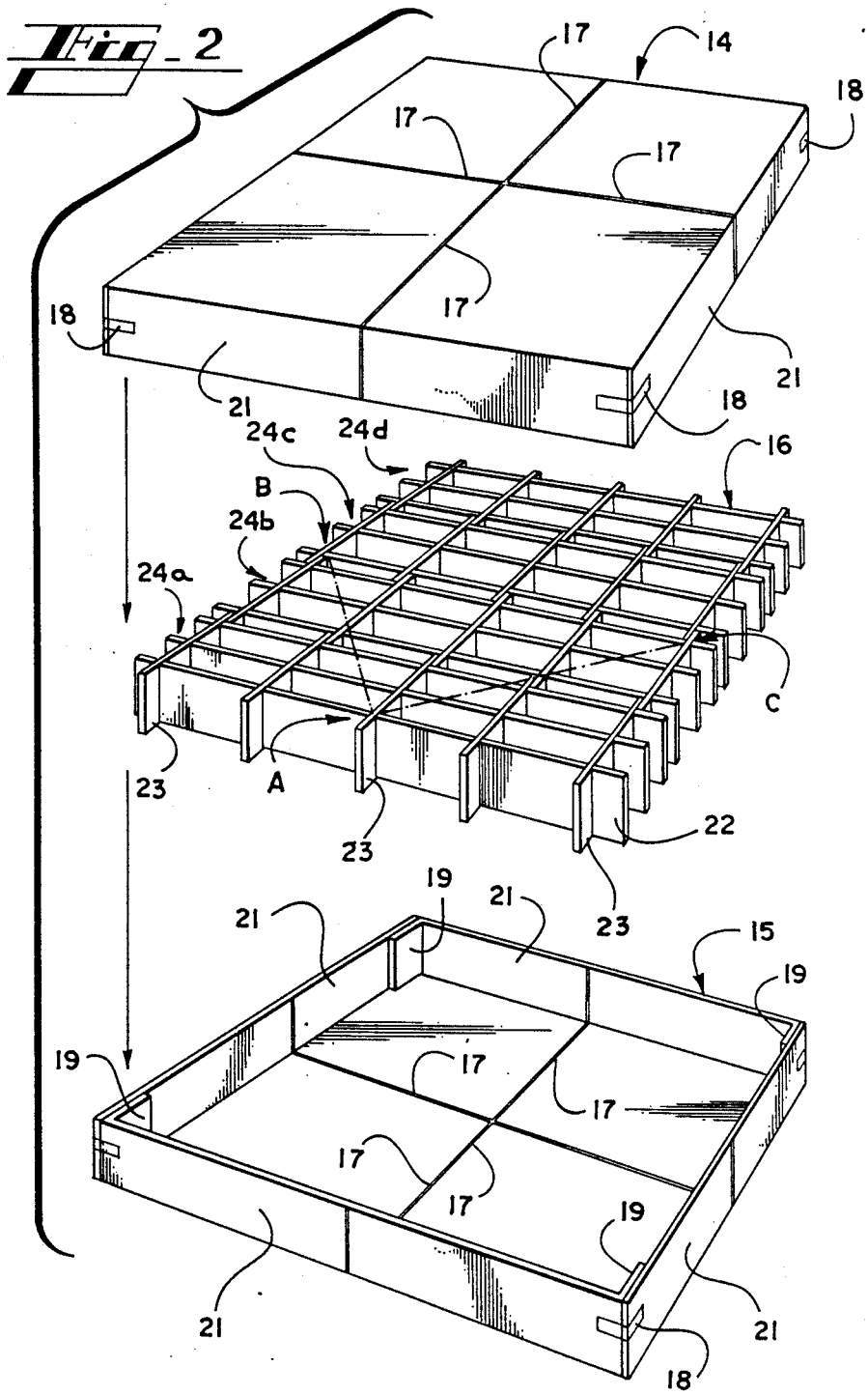
FIG. 2 is an exploded perspective view showing the foundation base, the honeycomb inserts and the cap.

Referring to the drawings wherein like numerals designate corresponding parts throughout the several figures, the mattress and foundation system of the present invention is shown generally by numeral 11. The mattress and foundation system is composed of a mattress section 12 and a foundation section 13 to give a unified overall conventional appearance.

Referring now to FIG. 2, which shows an exploded view of the foundation section 13, the foundation is generally constructed of a foundation cap 14, a foundation base 15 and one or more foundation inserts 16. The foundation cap 14 is typically a single sheet of waterproofed corrugated cardboard or similar material which, for shipping purposes, is folded into a neat square along fold lines 17. The fold lines are score line impressions along the corrugated cardboard to effect the easy folding and unfolding the foundation cap as desired. To make the foundation cap functional, the ultimate user would unfold the entire piece and make a box therefrom much in the manner shown by FIG. 2. In order to secure the corners, securing means 18 would be placed around the corners as shown. The securing means would typically be adhesive tape or could well be something similar to a hook and loop fastening system. Once the corner flaps 19 are tucked under the edges 21, and the securing means affixed as shown, the foundation cap would be complete and read for use.

While the securing means 18 are shown to be externally mounted tape strips, either adhesive or hook and loop, it may well be that in actual practice the securing means could be internally mounted within the space defined by corner flap 19 and edge 21.

In assembling the foundation, the user would then construct a foundation base 15 much in the manner of unfolding the folded base 15 along fold lines 17, tucking corner flaps 19 under edge 21 and securing the corners with the securing means 18. In this way a foundation box assembly is completed which will nest one piece within the other.

To complete the foundation 13, the user would then construct the foundation inserts 16. These inserts, when properly formed, comprise a honeycomb unit which will be exceptionally strong and durable. It is contemplated that the inserts may be formed of corrugated cardboard or may be of any other suitable material that the manufacturer may design. A main requirement for the inserts is that the material be lightweight, flexible enough for shipment and yet suitable for forming a honeycomb unit as shown. The insert 16 would be comprised of notched cross grids 22 and notched lengthwise grids 23. To mate the grids together, it is anticipated that the cross grids 22 would be engaged at intervals from the top edge thereof towards the bottom approximately halfway through the width of the grid. Correspondingly, the lengthwise grids would be engaged from the bottom edge thereof approximately halfway through the width so as to mate with the cross grids 22. The user would then interlock the grids, one upon the other, by matingly engaging the grids at the notched sections so that one notch would fit down upon the other and be maintained in the respective notches.

It is anticipated that the foundation insert 16 would not be one unitary insert but would, in fact, comprises multiple units and, as shown in the embodiment of FIG. 2, there are four separate insert units indicated by numerals **24*a*, 24*b*, 24*c* and 24*d*. The purpose of having multiple inserts would be the ease of shipment and storage so that, if desired, the inserts could be preassembled and then folded in such a manner that they lie substantially flat for shipment and storage. With multiple inserts, the resulting package would be substantially less bulky because the grids would tend to fold into a tighter, flatter package without the additional bulk of a great number of cross and lengthwise grids. To complete the foundation section 13, the user would place the multiple foundation inserts 16 into the foundation base 15, and then mate the foundation cap 14 over the unit to form an integral box-like structure of unusual strength and rigidity. A broken away perspective view of a corner of the completed foundation section is more particularly shown in FIG. 3**, which figure shows the cooperative nature of the three main portions of the foundation section. The resultant corner is quite rigid and will not deform or sag, even under heavy weight.

It has been found that, in some larger foundation sizes, it may well be advisable to provide additional bracing to the inserts 16 by placing one or more diagonal bracing grid members spaning the individual insert units, or multiple insert units, thereby offering additional structural rigidity to the entire system. While, for the sake of clarity, the diagonal bracing is not shown in the drawings, it is anticipated that such bracing would have the same notched configuration as the grids 22 and 23 and would be matingly engaged with said grids at an acute angle thereto. For instance, such a diagonal brace might well be placed from point A to point B, and another from point A to point C. Other combinations of diagonal bracing grids may well be utilized as the need arises.

Figure 4:
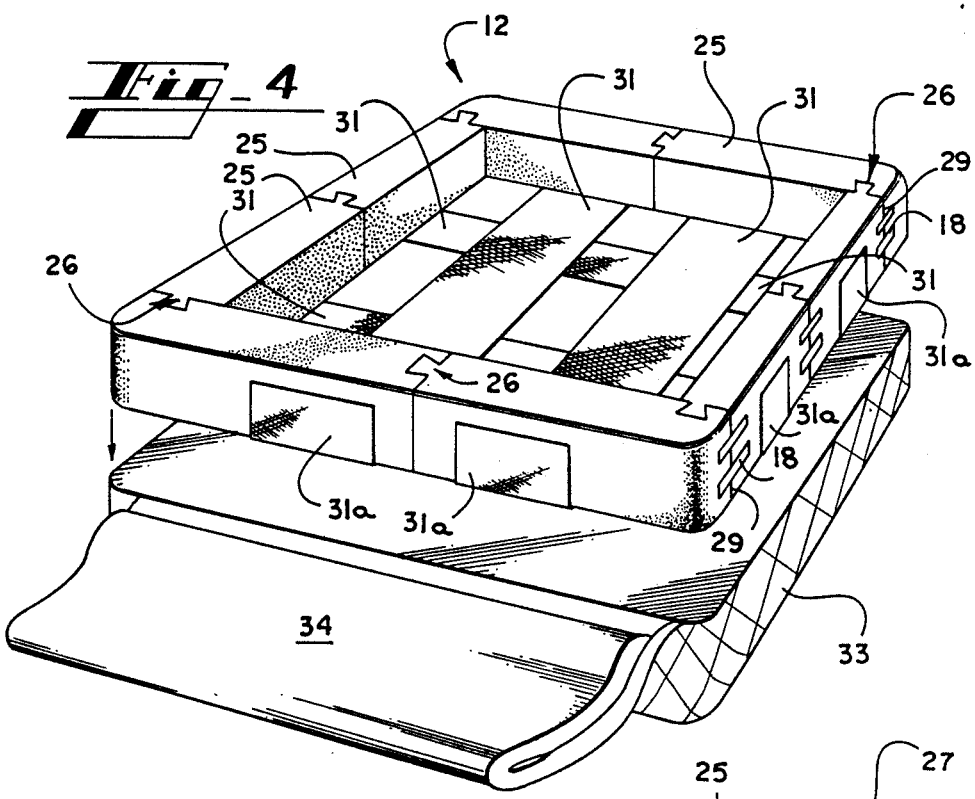
FIG. 4 is a perspective view of the interlocking sidewall rail units of the mattress and of the ticking cover.

Referring now to FIG. 4, the mattress section 12 comprises special foam sidewall rail units 25 having a unique interlocking design, generally indicated by number 26. The sidewall rail units 25 are designed to stack, or fold, into a compact size when disassembling the perimeter for storing, packing or shipping.

Figure 5:
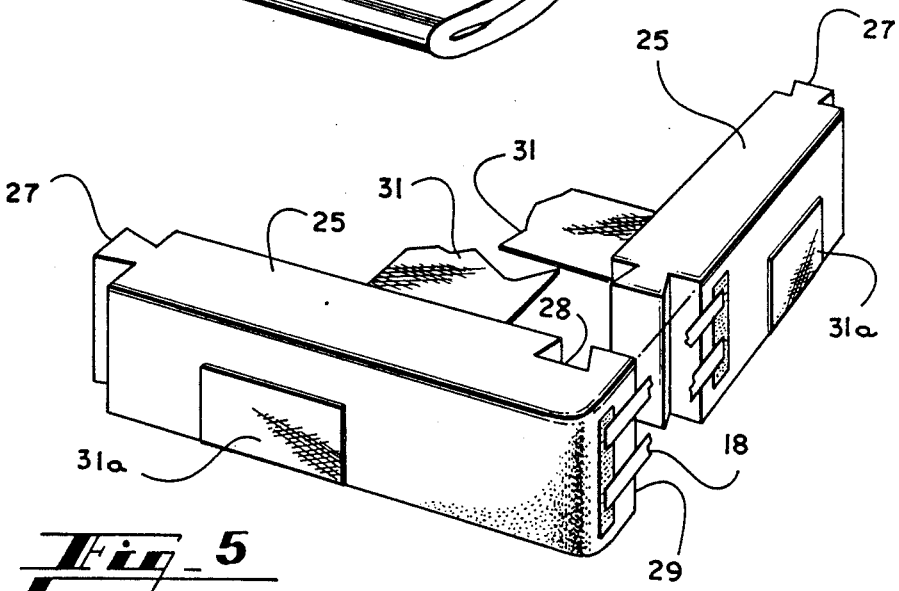
FIG. 5 is a partial perspective view showing the interlocking sidewall rail units, the method of maintaining the interlocking rails together, and of the support in both the length and width directions to maintain the rails from bowing.

In order to maintain the sidewall rail units 25 together in a unitary fashion, the units are interlocked by means of members 26. The interlocking members are more particularly shown in FIG. 5 wherein the members are comprised of a keystone shaped tongue 27 and a mating grove 28. Preferrably, both the tongue-and-groove are formed the entire length of the units 25 to provide adequate engagement. To assemble the units, it is anticipated that the tongue 27 would be placed into the mating grove 28 to form an interlocked, clamped securing system as shown in the drawings. However, since the rail units 25 are of a flexible foam configuration, the interlock tongue-and-groove members would not hold the side wall rails in a rigid manner if transverse loads are placed thereon. Therefore, to maintain the interlocking members firmly affixed to one another at all times, securing means 18 are generally placed over the joints 29 between the particular units. The securing means, as alluded to before in the foundation section, can be either an adhesive tape member stretched across the joints 29, or may well be a typical hook and loop fastening system.

To further secure the sidewall rail units 25 and to prevent bowing of the sidewalls upon transverse pressure being applied, it is anticipated that the mattress unit will be supplied with low-stretch support tapes 31. These tapes are placed both in lengthwise and crosswise directions of the mattress, and are anticipated to go under the units 25 and fold up closely to the sides of the units and be affixed thereto as noted by numeral 31*a*. Of course the fold up portions 31*a* may be affixed to the sidewall rail units by a suitable adhesive or another securing means such as a hook and a loop fastener system. Once the sidewalls rail units 25 have been properly assembled into the basic mattress configuration, the support tapes 31 would be securely placed in the intended positions which will allow a desired insert to be placed into the cavity 30 formed by the side wall rail units. The insert may be water or other fluid, foam, an innerspring unit or other support system without the possibility of the sidewall rail units 25 bowing outwardly.

Figure 8:
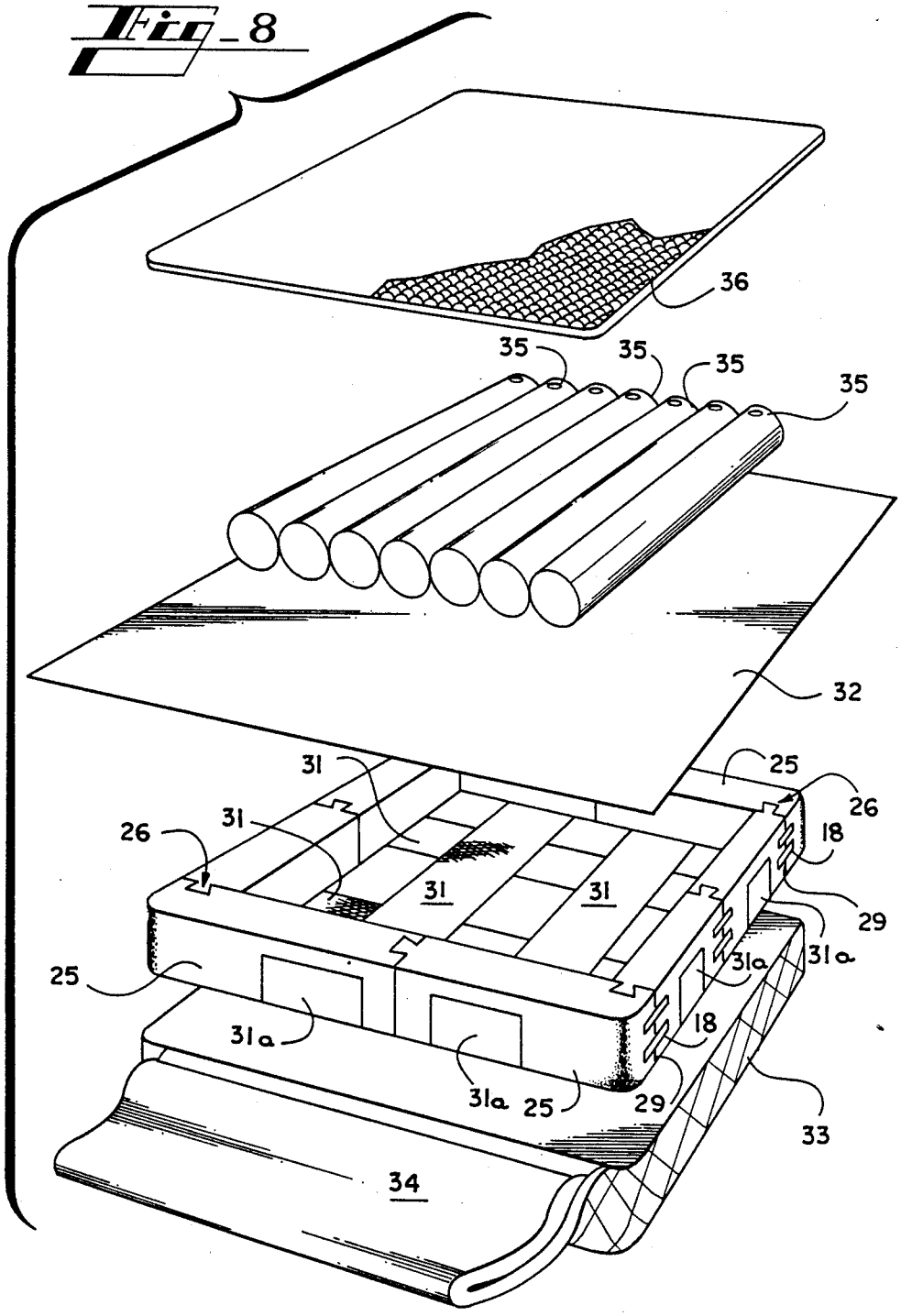
FIG. 8 is an overall exploded perspective view of the mattress section of the present invention.

To enhance the construction of the mattress and to act as additional reinforcement to the sidewall rail units 25, and to further prevent the possibility of leakage of a water flotation system within the cavity 30, a waterproof vinyl liner 32 (shown in FIGS. 6 and 8) is placed over the sidewall rail units 25 down into the cavity formed therein. The placement of the liner, as noted, surrounds the rail units and the liner provides additional reinforcement as well as providing waterproofing to the foam. This will eliminate any exposure of the foam walls to water or other substances that might be placed within the cavity. It also acts as a waterproof container for placing water mattresses, or other inserts, and eliminates potential problems of leaks outside the perimeter cavity. In addition, the liner acts as a buffer and protection for the foam sidewall rail units against any cavity inserts that might be placed within the cavity. It is anticipated that the liner 32 will be specially cut to fit snuggly over the perimeter and sealed at the ends to prevent splits from occuring in the vinyl, or allowing the foam to separate.

In order to give the mattress section 12 the same outward appearance as the foundation section 13, a mattress ticking cover 33 is constructed to form a baglike member into which the entire fully assembled sidewall rail units 25 and the vinyl liner 32 is placed. In effect, the mattress ticking cover 33 is a large bag which receives the assembled sidewall rail units 25 into the cover 33 and then the top 34, of the ticking cover 33, would be unfolded and placed upon top of the unit formed by the sidewall rail units 25 once the support cavity has been filled with the suitable support means.

As seen in FIG. 7, the mattress section 12 is shown in its entirety with support means fitted within cavity 30. These support means, as shown, may be a plurality of tubes 35 laid within the cavity 30. If the mattress support means is to be of a waterbed construction, the tubes 35 might well be a vinyl sleeve which is filled with water, other suitable fluids, or even other types of filler materials. However, if the customer desires a foam support system, the tubes may well be a foam member placed within the cavity. It is also anticipated that the support system might well be an innerspring arrangement which would be laid within the cavity much as the tubes are laid therein. It is evident that a number of support systems may be placed within the cavity 30 of the mattress section to fit the desires of any particular customer.

Once the support system is placed within the cavity it may well be that to effect a unitary bedding top, a pad or foam member 36 will be laid atop the bedding fluid inserts and overlying the sidewall rail units 25 which, at this point, is covered with the vinyl liner 32. In this way any irregularity of the support inserts would be eliminated. After the pad 36 is placed atop the unit, the customer in assembling the bed would then fold the top cover 34 over the entire unit to give a finished appearance. If desired, the top cover could be maintained in its final position by a zipper around a substantial part of the periphery of the mattress unit 12.

As alluded to earlier, the foundation inserts 16 are assisted in maintaining their shape by an overlap between the individual insert units, as more particularly shown in FIG. 9. To prevent movement between the foundation insert units, which would have a deleterious effect on the strength and stability of the foundation section 13, each lengthwise grid of units 24*a*–24*d* has a free end 37, which is designed to overlap a matching free end 37 of the adjacent unit. In addition to overlapping the adjacent end, the distal edge 38 lies against and abuts the side of the most near cross grid 22. By such an arrangement, the lateral and longitudinal tenancy of movement of the insert units is highly restricted.

As can be seen from the above description, a very compact and highly mobile mattress foundation system is shown which has great ease of portability and is easily assembled by an average user without hand tools. The system may be shipped to the ultimate user's residence in a minimal number of cartons, which are easily handled by the ultimate user, and the ultimate user may easily assemble or disassemble the mattress and foundation system without any tools or specialized knowledge. Essentially, the entire system would be assembled much in the same order as has just been described. While certain preferred materials have been disclosed for the manufacture of the system herein, there are other types of materials which would be adequate for the purposes desired, and the description of the preferred materials should not be deemed limiting in that regard.

Various modifications may be made of the invention without departing from the scope thereof; and, it is desired, therefore, that only such limitations shall be placed thereon as are imposed by the prior art and which are set forth in the appended claims.

What is claimed is:

1. A knock-down, lightweight and easily transportable mattress and foundation assembly comprising a mattress section and a foundation section, the mattress section having a plurality of interlocking sidewall rail units of a resilient material, the sidewall rail units having interlocking means at opposed ends of said units to maintain the units in a continuous perimeter defining a central cavity therein, reinforcing means connecting opposed sides of the sidewall rail units to prevent lateral movement of said sidewalls, a liner means overlying and emcompassing the entire sidewall rail unit to form a receiving cavity within the center cavity defined by the sidewall rail unit, sleep support means being nestled on top of the liner means and within the cavity formed by the sidewall rail unit, a reinforcing bag enclosure means adapted for the placement of the entire assembled mattress section thereinto, the bag enclosure means having a cover adapted to overlie the assembled sidewall rail units, the foundation section having a cap and a base, the base being fitted in telescoping relationship with the cap, a plurality of foundation inserts encompassed within the telescoped cap and base thereby providing rigidity thereto, the cap having a planar configuration with multiple score-lines embossed therein for folding the cap in a relatively small package, the base having a planar configuration with multiple score-lines embossed therein for folding the base in a relatively small package, the foundation inserts comprising a honeycomb configuration of multiple cross grids interconnecting with multiple lengthwise grids to form a series of individual discrete cells there between, each cross grid being notched at predetermined locations, and cross grids and lengthwise grids being matingly engaged at respective notches to form a honeycomb cell structure, a ticking enclosure means into which the foundation section is inserted to form a conventional appearing foundation section,

2. The mattress and foundation assembly as claimed in claim 1, wherein the interlocking means of the sidewall rail units comprise a mating tongue-and-groove at the juncture of the opposed ends of said units.

3. The mattress and foundation assembly as claimed in claim 1, wherein said reinforcing means connecting the opposed sides of the sidewall rail units comprise a first low-stretch flexible band affixed to a sidewall rail unit and one side of the perimeter and extending under the sidewall rail unit and across said center cavity to a sidewall rail unit on the substantially opposite side of the perimeter, wherein said band is affixed to said sidewall unit on the opposite side of the perimeter, a second low-stretch flexible band affixed to a sidewall rail unit at another side of the perimeter and extending under said sidewall rail unit and across said center cavity substantially perpendicular to the first band, and terminating on the opposite side of the perimeter and being affixed to a corresponding sidewall rail unit.

4. The mattress and foundation assembly as claimed in claim 1, wherein the foundation cap comprises a top and four sidewall members which are adapted to be folded along certain of said scorelines to form a box-like enclosure, certain of said sidewall members having end flaps adapted to be folded about other of said sidewall members to form reinforced corner, securing means attached to said sidewall flaps to secure said flaps to the other of said sidewalls, the base of the foundation further having a bottom and four sidewall members which are adapted to be folded along certain of said scorelines to form a box-like enclosure, certain of said sidewall members having end flaps adapted to be folded about other of said sidewall members to form a reinforced corner, securing means attached to said sidewall members to form a reinforced corner, securing means attached to said sidewall flaps to secure said flaps to the other of said sidewalls.

5. The mattress and foundation assembly as claimed in claim 1, wherein a plurality of foundation inserts are combined within the interior of the foundation base and overlaid with the foundation cap to form said foundation section.

6. The mattress and foundation assembly as claimed in claim 5, wherein the plurality of foundation inserts are placed adjacent and juxtaposed to one another to form a continuous honeycomb configuration within the interior of the foundation base, means for interlocking the multiple foundation inserts at the juxtaposed juncture thereof to add structural rigidity.

7. The mattress and foundation assembly as claimed in claim 6, further comprising diagonal brace means notched at predetermined locations and being matingly engaged with both the cross grids and the lengthwise grids at an acute angle thereto to provide structural rigidity to said foundation inserts.

8. The mattress and foundation assembly as claimed in claim 1, wherein said sleep support means comprises at least one fluid filled container.

9. The mattress and foundation assembly as claimed in claim 1, wherein said sleep support means comprises multiple elongated fluid filled units.

10. The mattress and foundation assembly as claimed in claim 1, wherein the sleep support means comprises a resilient pad means.

11. The mattress and foundation assembly as claimed in claim 1, wherein the sleep support means comprises a conventional coiled spring mattress unit.

12. The mattress and foundation assembly as claimed in claim 1, wherein a resilient pad means overlies the sleep support means and is placed between the bag enclosure means cover and the sleep support means.

13. A knock-down, light-weight and easily transportable mattress and foundation assembly comprising a mattress section and a foundation section, the mattress section having a plurality of interlocking sidewall rail units of a resilient material, the sidewall rail units having interlocking means at opposed ends of said units to maintain the units in a continuous perimeter defining a central cavity therein, the interlocking means comprising a mating tongue-and-groove at the juncture of the opposed ends of said units, reinforcing means connecting opposed sides of the sidewall rail units to prevent lateral movement of said sidewalls, said reinforcing means comprising a first low-stretch flexible band affixed to a sidewall rail unit and one side of the perimeter and extending under the sidewall rail unit and across said center cavity to a sidewall rail unit on the substantially opposite side of the perimeter, wherein said band is affixed to said sidewall unit on the opposite side of the perimeter, a second low-stretch flexible band affixed to a sidewall rail unit at another side of the perimeter and extending under said sidewall rail unit and across said center cavity substantially perpendicular to the first band, and terminating on the opposite side of the perimeter and being affixed to a corresponding sidewall rail unit, a liner means overlying and encompassing the entire sidewall rail unit to form a receiving cavity within the center cavity defined by the sidewall rail unit, sleep support means being nestled on top of the liner means and within the cavity formed by the sidewall rail unit, a reinforcing bag enclosure means adapted for the placement of the entire assembled mattress section thereinto, the bag enclosure means having a cover adapted to overlie the assembled sidewall rail units, a resilient pad means overlying the sleep support means and being placed between the bag enclosure means cover and the sleep support means, the foundation section having a cap and a base, the base being fitted in telescoping relationship with the cap, a plurality of foundation inserts encompassed within the telescoped cap and base thereby providing rigidity thereto, the cap having a planar configuration with multiple score-lines embossed therein for folding the cap in a relatively small package, the cap further having a top and four sidewall members which are adapted to be folded along certain of said scorelines to form a box-like enclosure, certain of said sidewall members having end flaps adapted to be folded about other of said sidewall members to form a reinforced corner, securing means attached to said sidewall flaps to secure said flaps to the other of said sidewalls, the base having a planar configuration with multiple score-lines embossed therein for folding the base in a relatively small package, the base further having a bottom and four sidewall members which are adapted to be folded along certain of said scorelines to form a box-like enclosure, certain of said sidewall members having end flaps adapted to be folded about other of said sidewall members to form a reinforced corner, securing means attached to said sidewall members to form a reinforced corner, securing means attached to said sidewall flaps to secure said flaps to the other of said sidewalls, the foundation inserts comprising a honeycomb configuration of multiple cross grids interconnecting with multiple lengthwise grids to form a series of individual discrete cells there between, each cross grid being notched at predetermined locations, each lengthwise grid being notched at predetermined locations, said cross grids and lengthwise grids being matingly engaged at respective notches to form a honeycomb cell structure, a plurality of foundation inserts being combined within the interior of the foundation base and overlaid with the foundation cap to form said foundation section, means for interlocking the multiple foundation inserts at the juncture thereof to add structural rigidity, diagonal brace means notched at predetermined locations and being matingly engaged with both the cross grids and lengthwise grids at an acute angle thereto to provide structural rigidity to said foundation inserts, a ticking enclosure means into which the foundation section is inserted to form a conventional appearing foundation section.

14. The mattress and foundation assembly as claimed in claim 13, wherein said sleep support means comprises at least one fluid filled container.

15. The mattress and foundation assembly as claimed in claim 13, wherein said sleep support means comprises multiple elongated fluid filled units.

16. The mattress and foundation assembly as claimed in claim 13, wherein said sleep support means comprises a resilient pad means.

17. The mattress and foundation assembly as claimed in claim 13, wherein said sleep support means comprises a conventional coiled spring mattress unit.

18. A method of assembling a knock-down, lightweight and easily transportable mattress and foundation system comprising, providing a mattress section having a plurality of interlocking sidewall rail units of a resilient materials, said sidewall rail units having interlocking, mating tongue-and-groove means at opposed ends of said units to maintain the units in a continuous perimeter which defines a central cavity therein, providing reinforcing means connected to opposed sides of the sidewall rail units perimeter thereby preventing lateral movement of said sidewalls by connecting a first, low-stretch flexible band affixed to a sidewall rail unit and one side of the perimeter and extending under the sidewall rail unit and across said center cavity to a sidewall rail unit on the substantially opposite side of the perimeter and affixing said band to said sidewall unit on the opposite side of the perimeter, providing a second low-stretch flexible band and affixing said band to a sidewall rail unit at another side of the perimeter and extending the band under said sidewall rail unit and across said center cavity substantially perpendicular to the first band, and terminating the second band on the opposite side of the perimeter and affixing the second band to a corresponding sidewall rail unit, placing a liner means over and encompassing the sidewall rail unit to form said receiving central cavity, providing a sleep support means nestled on top of the liner means and within the center cavity, placing the entire assembled mattress section into a reinforcing bag enclosure means having a conventional appearance, providing a foundation section having a cap and a base, providing the cap with a planar configuration and with multiple scorelines embossed therein, folding the cap along said scorelines to form a top and four sidewall members thereby forming a box-like enclosure, providing the base with a planar configuration and with multiple scorelines embossed therein, folding the base along said scorelines to form a bottom and four sidewall members thereby forming a box-like enclosure adapted to be telescoped with the cap, inserting into the base box-like enclosure, a series of foundation inserts having a honeycomb configuration comprising multiple cross grids interconnecting with multiple lengthwise grids to form a series of individual discrete cells therebetween, telescoping the cap and base with the foundation inserts enclosed therein to form the foundation section, placing a ticking enclosure means about the foundation section to form a conventional appearing foundation.

* * * * *